US009011208B2

(12) United States Patent
Boehringer

(10) Patent No.: US 9,011,208 B2
(45) Date of Patent: Apr. 21, 2015

(54) DUAL-SPINDLE GRINDER

(71) Applicant: Hans Georg Boehringer, Nellingen (DE)

(72) Inventor: Hans Georg Boehringer, Nellingen (DE)

(73) Assignee: Emag Holding GmbH, Salach (DE)

( * ) Notice: Subject to any disclaimer, the term of this patent is extended or adjusted under 35 U.S.C. 154(b) by 0 days.

(21) Appl. No.: 13/752,488

(22) Filed: Jan. 29, 2013

(65) Prior Publication Data

US 2014/0094097 A1 Apr. 3, 2014

(30) Foreign Application Priority Data

Feb. 1, 2012 (DE) ..... 10 2012 001 898

(51) Int. Cl.

| | |
|---|---|
| ***B24B 5/42*** | (2006.01) |
| ***B24B 53/12*** | (2006.01) |
| ***B24B 53/053*** | (2006.01) |
| ***B24B 53/06*** | (2006.01) |
| ***B24B 27/00*** | (2006.01) |
| ***B24B 53/14*** | (2006.01) |
| ***B24B 5/04*** | (2006.01) |

(52) U.S. Cl.

CPC ..... *B24B 53/053* (2013.01); *B24B 53/06* (2013.01); *B24B 5/42* (2013.01); *B24B 27/0076* (2013.01); *B24B 53/14* (2013.01); *B24B 5/04* (2013.01)

(58) Field of Classification Search

CPC ..... B24B 5/42; B24B 5/421; B24B 5/04; B24B 53/053; B24B 27/0076

USPC ..... 451/49, 72, 249, 399, 246

See application file for complete search history.

(56) References Cited

U.S. PATENT DOCUMENTS

| | | | | |
|---|---|---|---|---|
| 4,122,635 | A * | 10/1978 | Asano et al. | 451/5 |
| 4,897,964 | A * | 2/1990 | Vetter | 451/72 |
| 5,595,528 | A * | 1/1997 | Becker | 451/72 |
| 8,342,911 | B2 * | 1/2013 | Morita et al. | 451/72 |
| 2011/0053467 | A1 * | 3/2011 | Dibner et al. | 451/49 |

FOREIGN PATENT DOCUMENTS

DE 102008055795 A 5/2010

* cited by examiner

*Primary Examiner* — Robert Rose

(74) *Attorney, Agent, or Firm* — Andrew Wilford

(57) ABSTRACT

A machining apparatus has a frame carrying a headstock capable of gripping one end of an elongated workpiece and rotating the workpiece about a machining axis. A turntable support is spaced axially from the headstock on the frame. A tailstock carried on the support can be aligned with the machining axis in a machining position of the support. A machining drive is carried on the frame and itself carries a rotatable grinding disk engageable radially of the machining axis with the workpiece when the workpiece is engaged between the headstock and tailstock. A dressing tool carried on the support axially offset from the support axis and angularly offset about the support axis from the tailstock is engageable in a dressing position of the support with the grinding disk for dressing same in the dressing position with the workpiece engaged between the headstock and tailstock.

7 Claims, 3 Drawing Sheets

DUAL-SPINDLE GRINDER

FIELD OF THE INVENTION

The present invention relates to a machining apparatus. More particularly this invention concerns a dual-spindle grinder.

BACKGROUND OF THE INVENTION

A typical machining apparatus for machining an elongated workpiece extending along a workpiece axis as disclosed in DE 10 2008 055 795 has a frame, a headstock mounted on the frame and capable of gripping one end of the workpiece and rotating the workpiece about a machining axis substantially parallel to or coinciding with the workpiece axis. A tailstock also carried on the frame is aligned with the machining axis so as to engage and center an opposite end of the workpiece gripped by the headstock for rotation of the workpiece about the machining axis, typically by powered rotation of the headstock about the machining axis. A machining drive carried on the frame carries a rotatable grinding disk or wheel engageable radially of the machining axis with the workpiece when the workpiece is engaged between the headstock and tailstock and rotating about the machining axis so as to machine the workpiece. The machining axis is typically vertical, and there may be two identical machining drives with grinding disks for machining diametrally opposite sides of the workpiece at the same time.

With this machine a separate dressing tool can be engaged with the grinding disk for dressing same. Thus the grinding disk and/or dressing tool can be shifted into engagement with each other to allow the working edge and/or face of the grinding disk to be trued. Thus for a dressing operation the machine must be reconfigured, entailing considerable down time.

OBJECTS OF THE INVENTION

It is therefore an object of the present invention to provide an improved machining apparatus.

Another object is the provision of such an improved machining apparatus that overcomes the above-given disadvantages, in particular that allows the grinding disk or disks to be dressed in a simple matter.

SUMMARY OF THE INVENTION

These objects are attained in an apparatus for machining an elongated workpiece extending along a workpiece axis having a frame and a headstock mounted on the frame and capable of gripping one end of the workpiece and rotating the workpiece about a machining axis substantially parallel to or coinciding with the workpiece axis. The frame also carries a support spaced axially from the headstock and rotatable about a support axis transverse to the machining axis between a machining position and a dressing position. A tailstock is carried on the support offset from the support axis and aligned with the machining axis in the machining position so that in the machining position an opposite end of the workpiece gripped by the headstock can be engaged and centered by the tailstock for rotation of the workpiece about the machining axis. As in the prior art, a machining drive is carried on the frame and itself carries a rotatable grinding disk engageable radially of the machining axis with the workpiece when the workpiece is engaged between the headstock and tailstock and rotating about the machining axis so that, in the machining position with the workpiece engaged between the headstock and tailstock. The grinding disk can thus machine the workpiece. According to the invention a dressing tool carried on the support axially offset from the support axis and angularly offset about the support axis from the tailstock is engageable in the dressing position of the support with the grinding disk for dressing same so that, in the dressing position with the workpiece engaged between the headstock and tailstock, the dressing tool can dress the grinding disk.

Thus according to the invention the dressing tool can dress the grinding disk without having to move the machining drive carrying it significantly, or in some cases at all. All that is needed to dress the disk is to take the workpiece out of the machine, then pivot the support into the dressing position. Thereafter moving the machining drive in a manner similar to its movements during machining of the workpiece, that is axially and radially of the machining axis, can serve to dress the working faces and/or edge of the grinding disk.

Normally all that is needed is to render the edge of the grinding disk cylindrical, that is dress off any bumps or cut it down to eliminate any grooves, and to similarly make the faces of the disk flat. This is easily done by using a dressing tool that is a small and very hard grinding disk itself with a cylindrical edge face and planar axial end faces, with appropriate movement of the grinding disk of the machining drive against the dressing disk while same rotated about the machining axis.

According to the invention it is also possible, if necessary, to angle the dressing disk so its axis forms an acute angle with the machining axis. In this manner it is possible to form a radially outwardly open groove in the edge face of the grinding disk, or an axially open groove in a side face of the grinding disk.

BRIEF DESCRIPTION OF THE DRAWING

The above and other objects, features, and advantages will become more readily apparent from the following description, reference being made to the accompanying drawing in which.

DETAILED DESCRIPTION OF THE INVENTION

Figure 1:
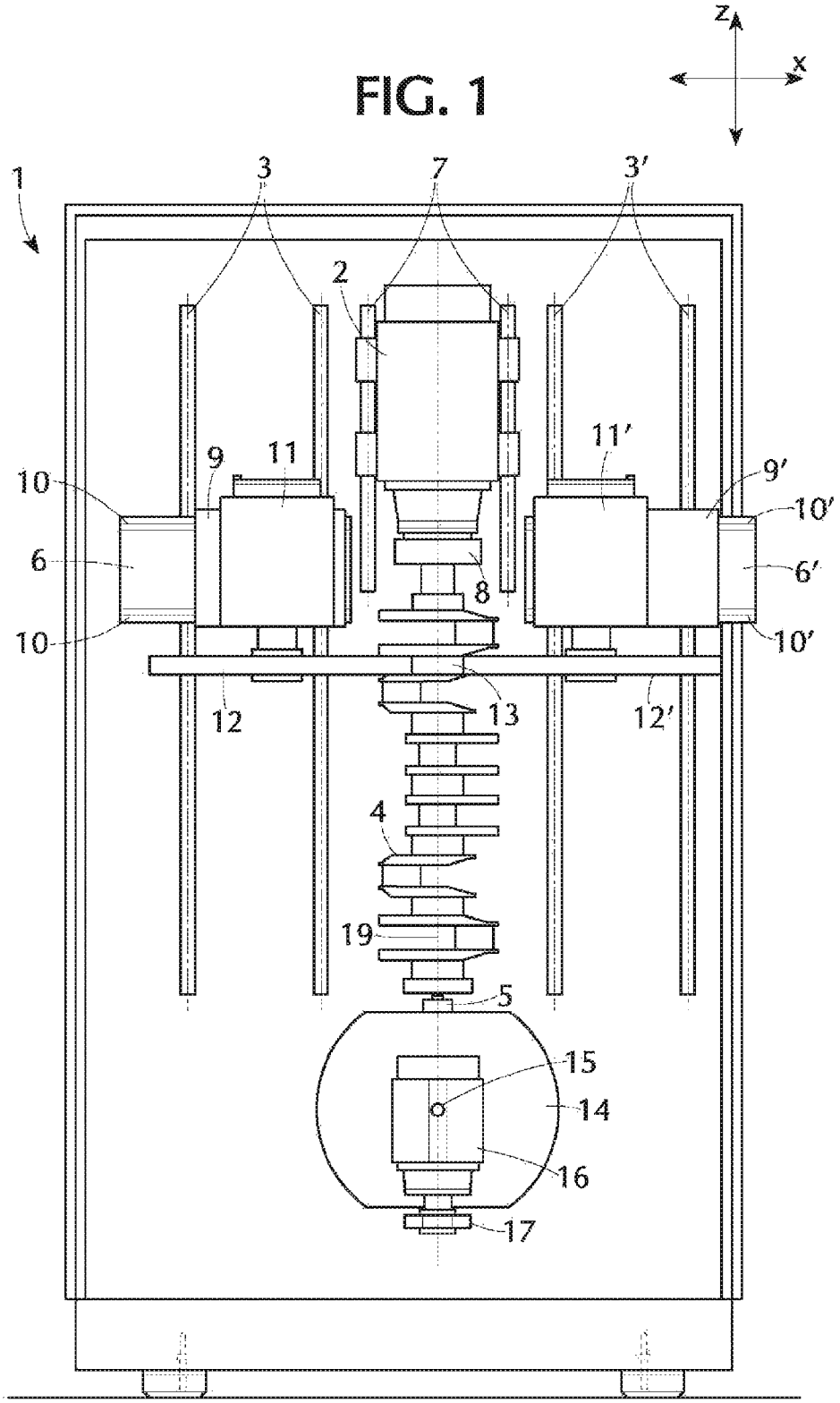
FIG. 1 is a front elevational view of the apparatus of this invention in a dual-spindle setup while machining a crankshaft workpiece.
Figure 2:
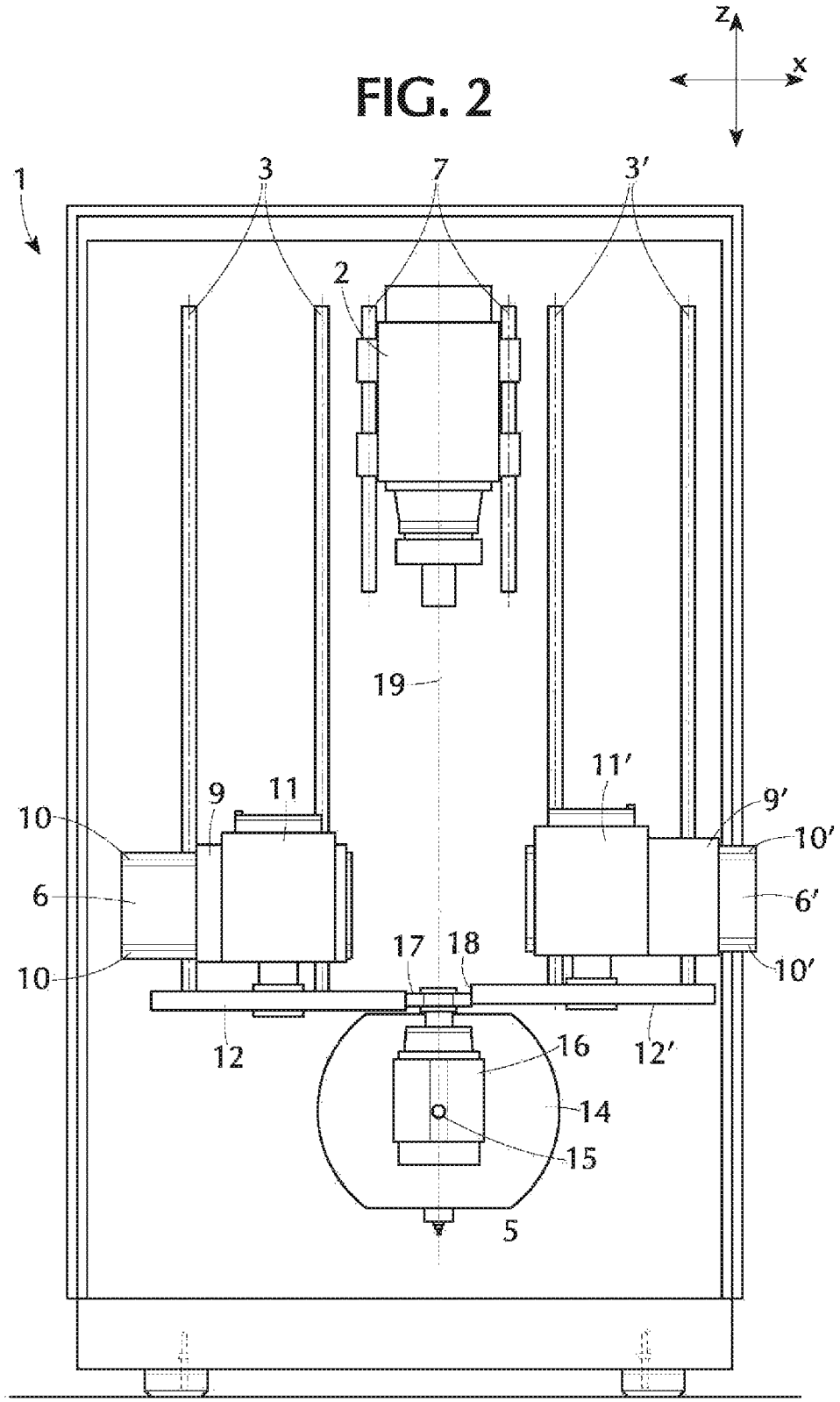
FIG. 2 is a view like FIG. 1 during dressing of the cylindrical outer edges of the grinding disks.
Figure 3:
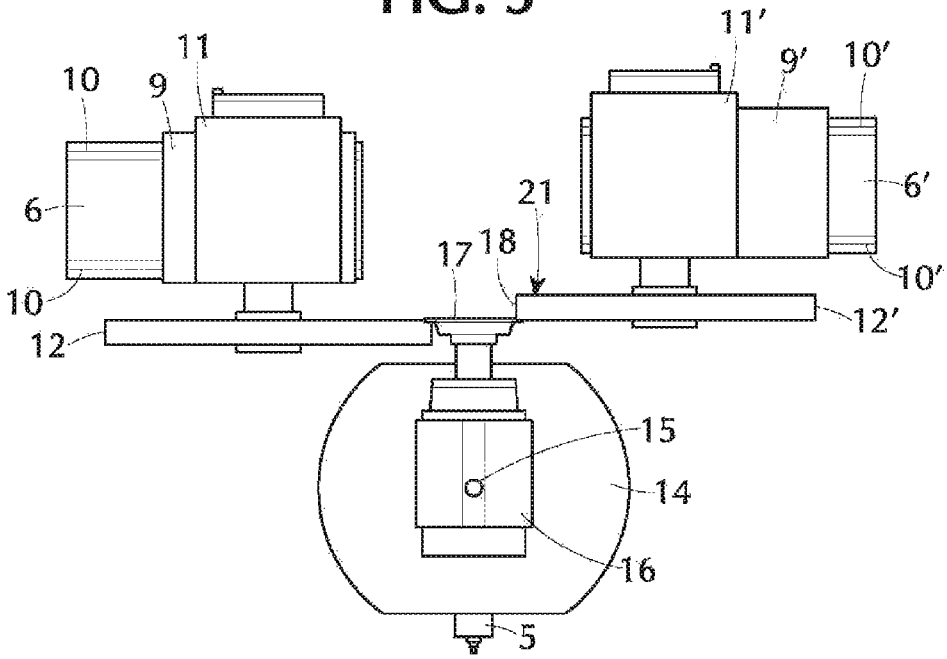
FIG. 3 is a view corresponding to a detail of FIG. 1 showing dressing of the faces of the grinding disks.

As seen in FIGS. 1 and 2, the machine according to the invention has a frame 1 with vertical center guide rails 7 carrying an upper machining drive or headstock 2 with a chuck 8 capable of gripping an upper end of an elongated workpiece, here a crankshaft 4, for rotation of the crankshaft 4 about its center axis on a vertical machining axis 19, which here is a vertical direction z). A lower end of the crankshaft 4 is engaged by a tailstock 5 that holds it on center. Unlike the prior art, this tailstock 5 is carried on a support or turntable 14 pivotal about a horizontal support axis 15 that perpendicularly intersects the machining axis 19.

When the turntable 14 is in the machining position shown in FIG. 1 and is rotating about the machining axis 19, two diametrally opposite cylindrical grinding disks 12 and 12' carried on respective machining drives or spindles 11 and 11' can engage opposite sides of the workpiece 4 to smooth and machine its journal surfaces 13. The drives 11 and 11' are carried on respective carriages 9 and 9' riding on horizontal guide rails 10 and 10' on respective carriages 6 and 6' themselves shiftable vertically along vertical guide rails 3 and 3' carried on the machine frame 1. Respective unillustrated drives can shift the machining drive 2 and carriages 6 and 6' vertically on the frame 1 parallel to the axis 19 while further unillustrated drives can shift the carriages 9 and 9' on the carriages 6 and 6', the displacements being managed by an unillustrated controller controlling these drives. The use of two complementarily operated and diametrally operated drives 11 and 11' ensures that the workpiece 4 does not bend and stays on center during the machining operation.

For dressing the grinding disks or disks 12 and 12' as shown in FIG. 2, the workpiece 4 is gotten out of the way and the turntable/support 14 is rotated by 180° about its axis 15 to bring a dressing drive 16 and dressing tool 17 carried on the support 14 diametrally opposite the tailstock/center 5 into alignment with the axis 19. The dressing tool 17 is a very hard cylindrical dressing disk that can be rotated by the drive 16 when in the dressing position of FIG. 2 about the machining axis 19. The normal movements of the disks 12 and 12' along and perpendicular to the axis 19 can ensure perfect dressing of the edge and side faces of the disks 12 and 12'. Shifting of the wheels 12 and 12' parallel of the axis 19 into engagement with the dressing wheel 17 dress the side faces planar, while shifting of the wheels 12 and 12' perpendicular to the axis 19 into engagement with the dressing wheel 17 dress the edge face to a cylindrical shape.

Figure 4:
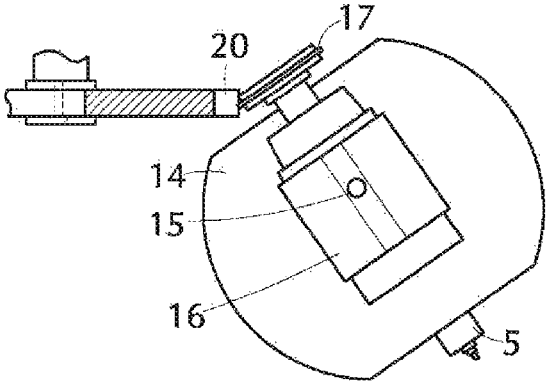
FIGS. 4 and 5 are detail views illustrating different orientations of the dressing tool for different styles of grinding-disk dressing.
Figure 5:
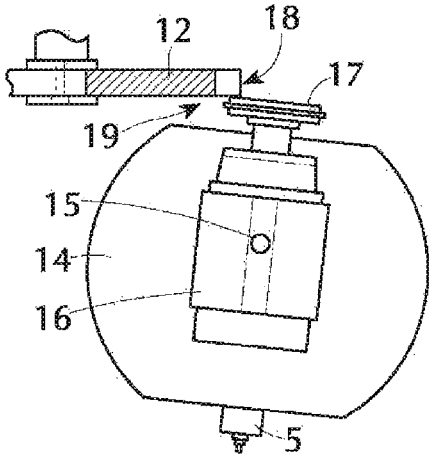

As shown in FIG. 4, it is possible to form an edge region 20 of the disk 12 with a profile, here a radially outwardly open center groove, by rotating a slim grinding disk 17 about an axis at 45° to the machining axis 19 and bringing the disk 12 or 12' to be grooved radially of the axis 19 (direction x) into engagement with the rotating disk 17. Similarly by tipping out the grinding disk 17 as shown in FIG. 8, an edge region 18 of the disk 12 can be formed with an undercut 19, that is an axially outwardly open annular groove.

Thus with the instant invention a single dressing drive 16 with a single tool 17 can be used to true all the working edges and faces of the disks 12 and 12'. Normally during such dressing the support turntable 14 is held stationary and the workpieces formed by the disks 12 and 12' are moved relative to the tool 17.

I claim:

1. An apparatus for machining an elongated workpiece extending along a workpiece axis, the apparatus comprising:

a frame;

a headstock mounted on the frame and capable of gripping one end of the workpiece and rotating the workpiece about a machining axis substantially parallel to or coinciding with the workpiece axis;

a support on the frame, spaced axially from the headstock, and rotatable about a support axis transverse to the machining axis between a machining position and a dressing position;

a tailstock carried on the support offset from the support axis and aligned with the machining axis in the machining position, whereby in the machining position an opposite end of the workpiece gripped by the headstock can be engaged and centered by the tailstock for rotation of the workpiece about the machining axis;

a machining drive carried on the frame and carrying a rotatable grinding disk engageable radially of the machining axis with the workpiece when the workpiece is engaged between the headstock and tailstock and rotating about the machining axis, whereby, in the machining position with the workpiece engaged between the headstock and tailstock, the grinding disk can machine the workpiece; and a dressing tool disk carried on the support axially offset relative to the machining axis from the support axis, centered on and rotatable about a dressing axis, and angularly offset about the support axis from the tailstock, the dressing disk being engageable in the dressing position of the support with the grinding disk for dressing same, whereby, in the dressing position with no workpiece engaged between the headstock and tailstock, the dressing disk can dress the grinding disk and in the machining position of the support the axis of the dressing disk coincides with the machining axis.

2. The machining apparatus defined in claim 1, wherein the apparatus comprises two of the machining drives with respective grinding disks that diametrally flank the workpiece relative to the machining axis.

3. The machining apparatus defined in claim 1, wherein the dressing disk axis is perpendicular to the support axis and the support axis is perpendicular to the machining axis.

4. The machining apparatus defined in claim 1, further comprising means for displacing the machining drive along and perpendicular to the machining axis.

5. The machining apparatus defined in claim 4, wherein the means for displacing include guides extending parallel to and perpendicular to the machining axis.

6. The machining apparatus defined in claim 1, wherein in the dressing position of the support the dressing axis forms an acute angle with the machining axis.

7. The machining apparatus defined in claim 1 wherein the machining axis is vertical and the support axis is horizontal and perpendicular to the machining axis.

* * * * *